United States Patent [19]

Raudman et al.

[11] Patent Number: 4,696,330

[45] Date of Patent: Sep. 29, 1987

[54] SPILL COLLECTOR ASSEMBLY FOR LIQUID STORAGE VESSELS

[76] Inventors: Charles J. Raudman, 877 Peri Ct., Redding, Calif. 96001; Philip E. Smith, 2781 Rancho Dr., Redding, Calif. 96002

[21] Appl. No.: 899,180

[22] Filed: Aug. 14, 1986

[51] Int. Cl.[4] ..... B65B 3/04

[52] U.S. Cl. ..... 141/86; 141/115; 141/326; 141/392; 137/312; 138/89; 220/85 F; 251/251; 251/252; 251/253; 285/302

[58] Field of Search ..... 285/302; 251/251, 252, 251/253; 141/85, 86, 87, 88, 285–310, 59, 98, 115, 392, 326, 325; 138/89; 220/85 F, 85 S, 86 R; 137/312, 381; 405/36, 52

[56] References Cited

U.S. PATENT DOCUMENTS

| | | | |
|---|---|---|---|
| 2,945,703 | 7/1960 | Ballard | 251/253 |
| 3,871,401 | 3/1975 | Lyons | 141/86 |
| 4,278,115 | 7/1981 | Briles et al. | 141/86 |
| 4,316,579 | 2/1982 | Ray et al. | 285/302 |
| 4,386,796 | 6/1983 | Lyall et al. | 285/302 |
| 4,390,063 | 6/1983 | Wells | 285/302 |
| 4,501,305 | 2/1985 | Zola et al. | 141/86 |
| 4,512,410 | 4/1985 | Forester | 285/302 |
| 4,520,852 | 6/1985 | Klein | 141/86 |
| 4,548,427 | 10/1985 | Press et al. | 285/302 |
| 4,659,251 | 4/1987 | Petter et al. | 141/86 |

FOREIGN PATENT DOCUMENTS

| | | | |
|---|---|---|---|
| 494599 | 7/1950 | Belgium | 251/253 |

*Primary Examiner*—Houston S. Bell, Jr.
*Attorney, Agent, or Firm*—Kenneth J. Hovet

[57] ABSTRACT

A receptacle for accumulating spilled liquids about the inlet pipe of a storage tank is slidably fitted within a stationary housing. The receptacle includes an outlet spout connected to the inlet pipe. A center pipe fits within the spout for connection to a supply line. Liquid flows from the supply line through the center pipe into the tank inlet pipe. Spillage is collected in the receptacle and, if desired, permitted to flow into the tank via valved passages in the receptacle bottom.

31 Claims, 14 Drawing Figures

SPILL COLLECTOR ASSEMBLY FOR LIQUID STORAGE VESSELS

BACKGROUND OF THE INVENTION

1. Field of the Invention

The present invention pertains to pollution prevention devices and, more particularly, to an assembly for use during the filling of liquid storage vessels to capture spilled liquids.

2. Description of the Prior Art

Much of the earlier prior art relating to liquid storage tanks dealt with atmospheric pollution and tank venting systems.. These were used to prevent excessive pressure build-up while preventing escape of pollutant vapors. Subsequently, concern arose regarding contamination of the soil. Toxic materials in the soil were found to create long-lasting hazardous conditions. Seepage of toxic liquids into ground water supplies affect not only drinking water, but crops which are consumned by animals and humans. Also, flammable liquids have been known to seep into basements and drainage systems creating explosive havoc.

One area of concern has been the prevention of spills about liquid storage tanks. Tanks that are repetitively depleted and refilled with toxic and/or flamable liquids are especially prone to spillage of pollutant chemicals. Most notable are the tanks used in the chemical industry to house reactants, solvents, by-products and finished materials. Also of note are the underground fuel tanks commonly found in service stations. In the above situations, spillage often occurs through tank overfilling, weak line connections, drainage from disconnected lines, faulty gaskets, leaky valve seals and the like.

Attempts to contain spillage from the above exemplary situations are described in U.S. Pat. Nos. 4,278,115; 4,501,305 and 4,520,852. U.S. Pat. No. 4,278,115 describes the construction of a manhole about the fill pipe of a storage vessel. The manhole bottom slopes toward a valved drain outlet leading to an auxiliary holding tank. Spilled liquids are received in the manhole and drained to the holding tank where they are accumulated for later removal.

A problem with the above device is that it is wholly dependent on the effectiveness of a seal about the manhole bottom and storage vessel fill pipe. Such a seal is necessary to accomodate axial movement of the fill pipe relative to the manhole bottom caused by natural forces such as earth movement, tank settling and pipe contraction and expansion resulting from ambient temperature variations. Unless the seal maintains its effectiveness during such movement, the spillage will leak directly into the soil beneath the manhole bottom.

Also, the addition of a separate holding tank and accompanying pipe, fittings and seals multiplies potential leakage sources. Still further, it creates substantial additional capital investment costs, installation costs and maintenance costs.

Another disadvantage is that the extra holding tank will require occasional pumping-out. Also, the connector piping and fitments must, in some manner, accommodate movement caused by the above-described natural forces. Clearly, all of the above add to the cost and unreliability of the auxiliary tank system.

U.S. Pat. Nos. 4,501,305 and 4,520,852 both disclose spill collectors that utilize polymer imbiber bends to selectively absorb organic fuels while allowing only water to pass into the surrounding earth. The obvious major disadvantage of the above concerns the need for frequent monitoring and replacement of the beads. In U.S. Pat. No. 4,501,305 this is especially important since the receptacle is open-ended. Once the beads have become saturated, additional spillage will flow directly into the soil.

Also, the device of U.S. Pat. No. 4,520;852 continues the aforementioned problem of the necessity for an effective sealing means between the storage tank fill pipe and the receptacle bottom. Constant monitoring and careful maintenance are required to insure that no leakage occurs.

In addition to the above, it should be noted that none of the aforereferenced prior art seek to fully prevent the entry of water into the receptacle. In fact, although covers are mentioned, the unsealed downwardly stepped rim designs of the cited art actually facilitate water flow about the cover periphery and into the spill receptacles. Obviously, this is detrimental since water is a contaminant for fuels and should be excluded whenever possible.

SUMMARY OF THE INVENTION

The present invention provides a device that eliminates the need for a sealed joint between a storage tank fill pipe and the bottom of a receptacle. In fact, with the subject invention, spilled liquids cannot enter the soil through any seal malfunction. The invention prevents water contamination and it does not utilize any type of absorbent material. Neither does it require an auxiliary tank and accompanying fitments for accumulating spilled liquids.

The invention comprises a spilled liquid receptacle or collector that is slidably fitted within a stationary housing. The receptacle includes a drain outlet and a spout which is secured to the inlet pipe of a storage vessel by attachment means.

The spout includes securement means for connection to a center pipe which has passageways that direct captured spilled liquid from the receptacle into the storage vessel. A value means is used to control the flow. The value means may include a spring biased cam system actuated by a handle. The center pipe provides a connection for an external liquid supply line and the outer housing includes an upstanding rim with an overlying cover to prevent water entry into the receptacle.

With the present invention, there is no sealed joint allowing direct access of pollutant liquids from the receptacle bottom to the earth. Movement of the storage vessel inlet pipe by natural forces will be directly transmitted to the receptacle which is free to move in an axial or longitudinal direction within the housing. No bellows seal, rings or gaskets are required about a movable fill pipe and a fail-safe spilled liquid capture system is thereby provided.

DESCRIPTION OF THE PREFERRED EMBODIMENTS

Figure 1:
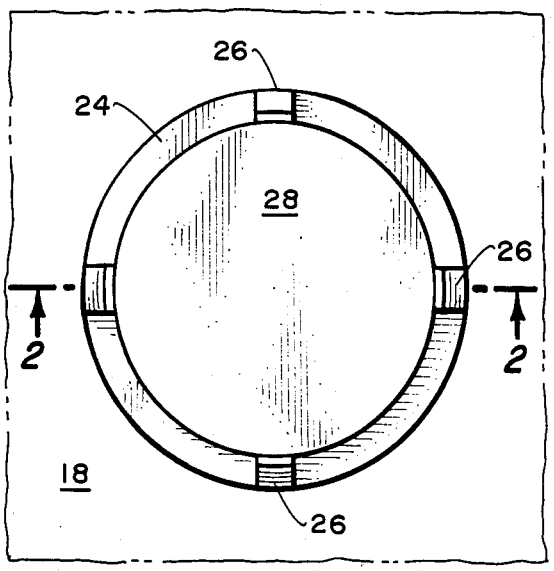
FIG. 1 is a top plan view of the overfill collector assembly, including cover, of the present invention.
Figure 3:
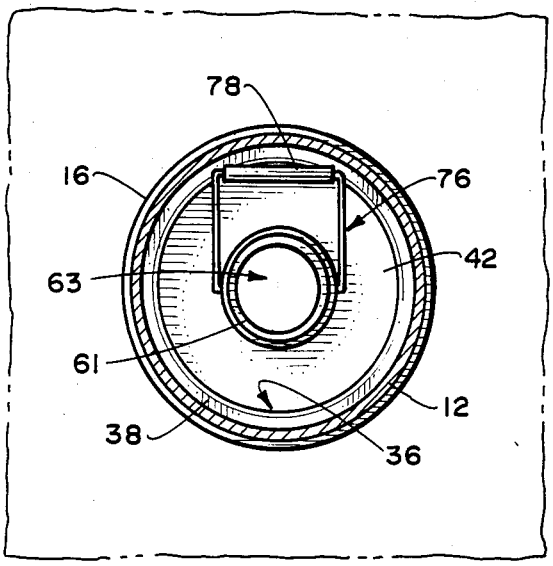
FIG. 3 is a reduced cross-sectional view taken along lines 3—3 of FIG. 2.

With reference now to FIGS. 1–5 of the drawings, the overall collector assembly of the invention is shown generally by reference numeral 10. It comprises a stationary housing 12 having an outer wall surface 14 that includes ridges 16 for anchoring the housing against movement in a foundation medium 18 such as concrete or asphalt.

The housing is preferably tubular-like in overall shape with a top opening 20 defined by upstanding rim 22. Stepped downwardly from the rim and extending outwardly therefrom is flange 24. The flange extends about the circumference of the housing and is reinforced by spaced-apart gussets 26.

The housing top opening is enclosed with cover 28. The cover periphery is provided with a downwardly extending lip 30. The diameter of the cover is greater than the diameter of the upstanding rim so that the cover lip is located radially outwardly therefrom. Preferably, the upper surface 29 of the cover is slightly dome-shaped and the aforementioned flange 24 inclines slightly downwardly through its outwardly extending radial extent. In this manner, any water impinging upon the covered assembly will drain from the cover to the flange and off the edge thereof.

The stationary housing is provided with a smooth inner wall surface 32. The surface is interrupted by an abutment means shown as annular projection 34 for a purpose to be hereinafter described. The projection is preferably located below the longitudinal midpoint of the housing inner wall surface.

Nested within the stationary housing is a funnel-like receptacle 36. The receptacle sidewall corresponds in cross-sectional shape to the tubular wall of the housing. The top portion of the receptacle wall terminates in a flared peripheral rim 38. The flared rim includes an outwardly facing surface 40 which is adapted to slide against the housing inner wall surface 32. It may also include an underlying O-ring 39 for sealing with said inner wall surface.

The lower portion of the receptacle sidewall tapers into a bottom wall 42 which merges inwardly to an annular bottom rim 43. The rim defines drain outlet opening 44 from which extends tubular spout 46. The spout includes inside wall 47.

Preferably, the bottom wall 42 of the receptacle inclines downwardly and inwardly toward bottom rim 43 so that the receptacle will gravity drain any liquids contained therein toward the drain outlet 44.

Secured to the spout and, preferably to the inside wall 47 thereof, is coupling member 50. The coupling member is provided with attachment means shown as inner threads 52 for connection to corresponding threads 53 on the upper end of inlet pipe 54.

The upper portion of the coupling member is provided with securement means shown as inner threads 56. Such threads engage corresponding threads 57 on the lower section 58 of center pipe 60.

The center pipe extends upwardly inside the receptacle interior a distance proximate the midpoint thereof. It wholly obstructs the drain outlet opening 44 and functions as a stand pipe wherein liquids may only flow into pipe opening 63 when the level within the receptacle exceeds the level of center pipe top edge 61.

It is expected that the upper section 62 of the center pipe will be covered with a protective cap (not shown) when not in use. The upper section also provides a connection, via outer threads 64 and an adaptor (not shown) to an external supply line. Typically, such line extends from a tank on a transport vehicle used to fill underground storage vessels.

Center pipe 60 includes one or more passageways shown as orifices 68 that permit liquid flow from the receptacle into the storage vessel inlet pipe 54. The orifices extend through the tubular wall of the center pipe and are spaced about the circumference thereof at a location about coextensive with, or below, rim 43.

To control fluid flow through the orifices, a valve means is utilized comprising an annular ring-like sleeve 70. The sleeve has sufficient width to overlie the orifices and is adapted to reciprocate axially along the center pipe longitudinal axis.

Sleeve 70 includes an inner seal member 72 that extends inwardly therefrom and engages the center pipe circumference to form a sliding seal between the sleeve and pipe. An outer seal member 74 is located axially downardly on the sleeve and extends outwardly therefrom. It seals against bottom rim 43 when the sleeve is in a position to overlie the orifices. In this closed position, fluid flow will be obstructed through the orifices as a result of outer seal engagement against the rim and inner seal engagement against the outer pipe circumference. Alternatively, seal member 72 may extend from a groove about the center pipe circumference directly above orifices 68 (not shown). It would then form a seal against the sleeve inner surface. Preferably, members 72 and 74 comprise resilient O-ring seals.

Figure 4:
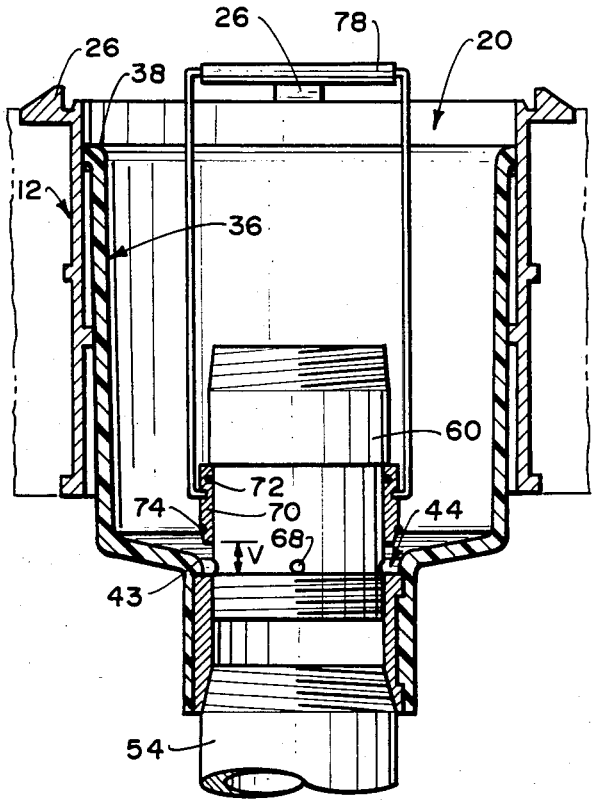
FIG. 4 is a cross-sectional view reduced from FIG. 2 with the housing cover removed and the valve means in an open position.

When it is desired to allow liquid to flow through the orifices, sleeve 70 may be moved upwardly along the center pipe as shown by arrow V in FIG. 4. This will expose the orifices to any accumulated fluids in the lower portion of the receptacle and permit them to flow therethrough into the lower section of the center pipe and into the storage vessel inlet pipe.

Preferably, the valve sleeve is connected to actuating means shown as U-shaped handle 76. Each opposing free end of the handle pivotally engages an opposing side of sleeve 70.

A particularly convenient way for insuring that the valve is in a normally closed position is by interaction between the handle and housing cover 28. The overall axial extent of the handle is made to be less than the vertical distance between the upstanding housing rim 22 and the sleeve when the sleeve is in its closed position, but with an axial extent greater than the vertical distance between the aforementioned rim 22 and the sleeve when it is in the open position. As so constructed, the handle will function as a lever by forcing the sleeve downwardly when cover 28 is positioned in place over the housing opening.

Figure 2:
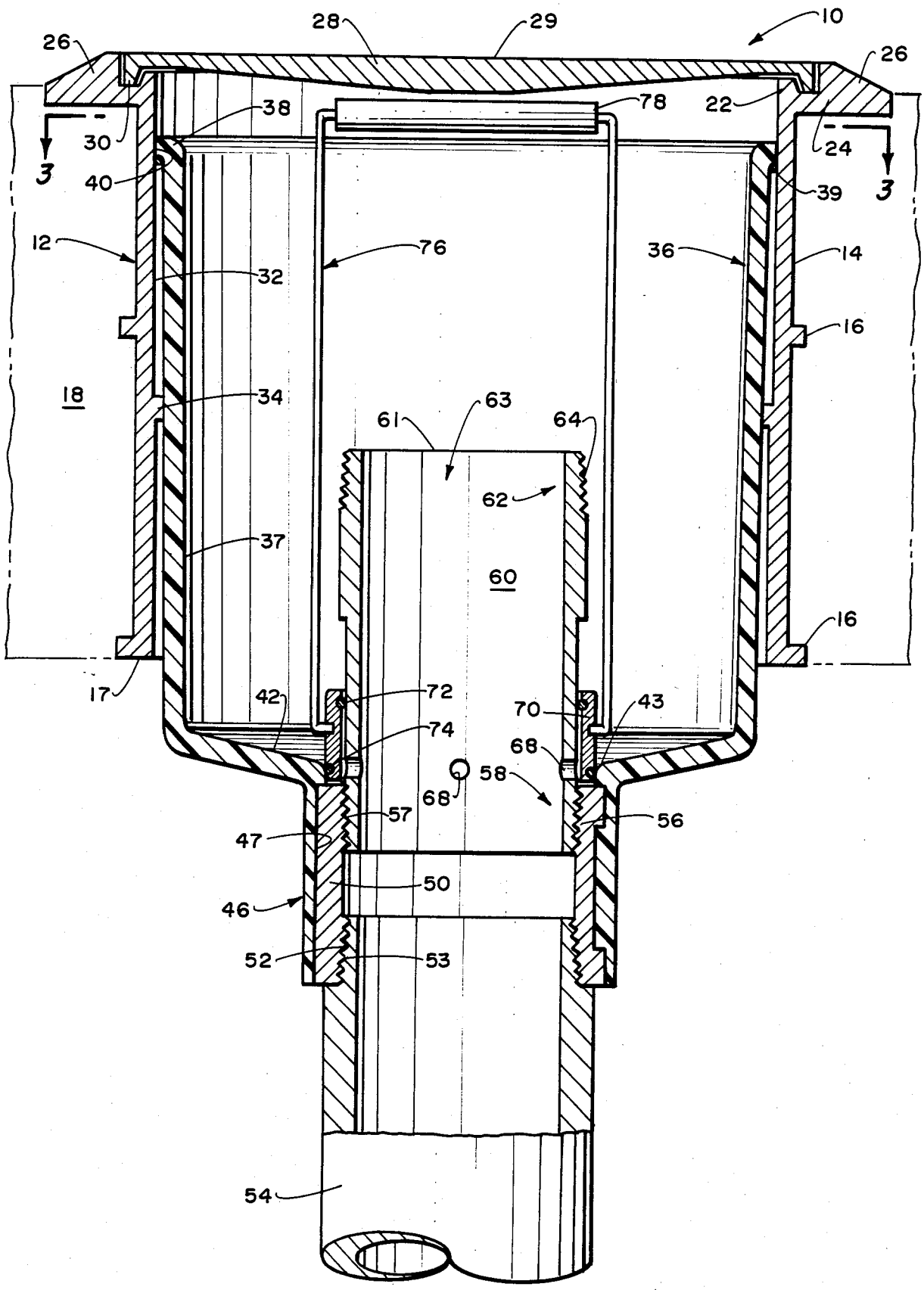
FIG. 2 is an enlarged cross-sectional view taken along lines 2—2 of FIG. 1.
Figure 6:
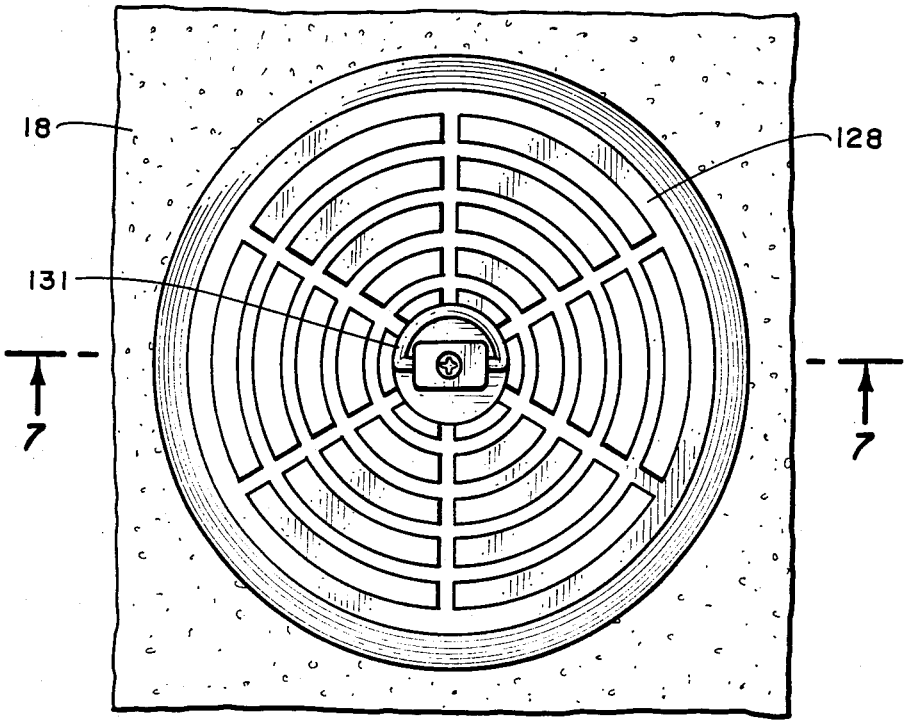
FIG. 6 is a top plan view of a modified version of the overfill collector assembly of the present invention, including a cover.
Figure 8:
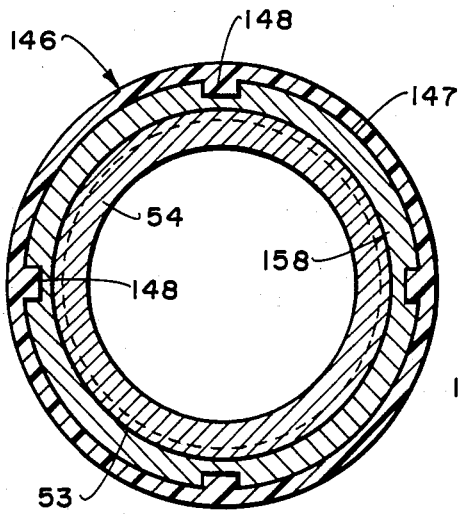
FIG. 8 is a cross-sectional view taken along lines 8—8 of FIG. 7.
Figure 9:
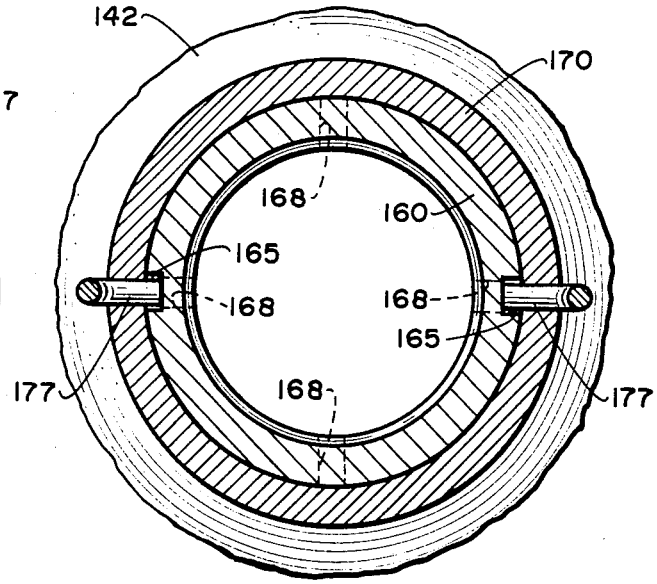
FIG. 9 is a cross-sectional view taken along lines 9—9 of FIG. 7.

FIG. 4 shows the position of handle bar 78 above the level of rim 22 when the valve sleeve is in an open position. In FIG. 2, the handle bar is beneath the underside of cover 28 with the valve sleeve in its closed position.

Figure 5:
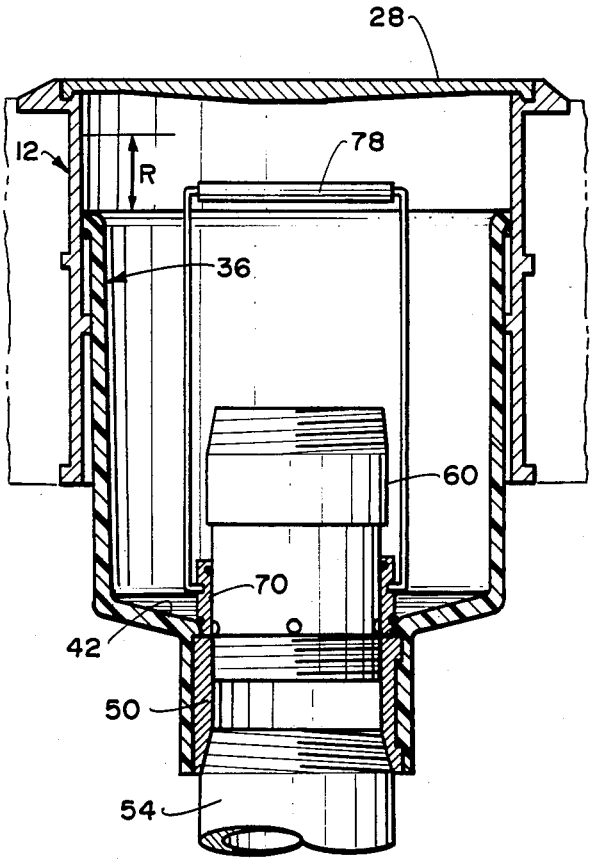
FIG. 5 is a cross-sectional view reduced from FIG. 2 showing the receptacle in a lowered position and the valve means in a closed position.

With reference now to FIG. 5, axial movement of receptacle 36 within stationary housing 12 is shown by arrows R. This movement results from the direct connection of the receptacle through coupling member 50 to the inlet pipe 54 which, in turn, is connected to an underlying storage vessel. Natural forces of expansion and contraction occuring with temperature changes, earth movement and tank settling will be readily accomodated with the above-described receptacle/housing sliding arrangement. To prevent the receptacle from sliding below the terminal end 17 of the housing, projection 34 on the inner wall surface 32 will engage flared rim 38 of the receptacle and inhibit further relative movement.

Operation of the assembly will not be described. It is expected that when not in use, the valve member will be in a closed position with the handle and cover in position as shown best in FIG. 2. A transport vehicle carrying a supply of liquid, such as fuel to a service station, will position itself adjacent and above the assembly. An operator will remove the housing cover 28 and clean out dirt and other impurities that may have entered the receptacle. The aforementioned protective and/or security cap known in the art will also then be removed from opening 63 and the supply line will be connected via an adaptor to the upper section 62 of the center pipe. Liquid flow from the transport vehicle tank will be permitted through the supply line, the center pipe, vessel inlet pipe and into the storage vessel itself.

When the operator discontinues flow, residual fuel retained within the supply line will typically flow-out by gravity upon disconnection of the line from the center pipe. Such fuel will be collected within the receptacle and, upon lifting handle bar 78 and pulling the sleeve member upwardly to an open position, the spilled fuel will flow through the passages 68 and into the aforementioned storage vessel. Thereafter, the valve is again closed by pushing down on handle 78, the protective cap replaced and the cover replaced over the housing.

It will be appreciated that if spillage exceeds the capacity of the receptacle, as defined by the volume from a level below the top edge 61 of the center pipe to the receptacle bottom wall, such excess will simply flow over the aforesaid edge 61 into the center pipe and into the storage vessel. Of course, if the vessel itself is overfilled, the excess liquid will simply have to be withdrawn therefrom. However, such would be visually readily apparent and flooding of the entire assembly easily prevented.

With reference now to FIGS. 6–14 of the drawings, a modified spill collector assembly 110 is shown. Overall, the basic inventive elements and their arrangement are the same as the FIGS. 1–5 embodiment. Minor variations are shown in the housing rim 122, cover 128, receptacle rim 138 and receptacle spout 146. The center pipe 160 has been altered to eliminate the need for a coupling and to accomodate a cam-operated spring biased valve means.

In particular, housing 112 is generally tubular in shape with a slightly flared lower region 115 that terminates at end 117. The flared region facilitates in-situ assembly above an underground storage vessel. The housing is embedded in a foundation medium 18 so that rings 116 will become anchored therein. Upper edge 123 of rim 122 is set about flush with the foundation surface. The rim is outwardly offset from housing wall 119 by shoulder 121.

Cover 128 has a slightly convex upper surface 129 that includes a recessed manual grasping member 131 for assisting in movement of the cover over housing opening 120. The cover includes a lip portion 133 that overlies edge 123. The cover also includes a downwardly extending annular flange 135 having an outer surface that is indented to retain a resilient ring 127 for sealing engagement with the inner surface of rim 122.

With the above arrangement, it will be apparent that the assembly will be nonobtrusive in a driveway or walkway. It is expected that the cover will be strong and preferably constructed of metal. As such, it may be walked upon or a vehicle may be driven thereover. Further, the cover overlies the entire housing eliminating direct exposure to the housing joint and seal. Also, the cover includes an annular sealing ring. With the above construction, water and all manner of contaminents will be prevented from entering the housing interior.

In sliding engagement with housing inner wall surface 132 is receptacle 136. The upper portion of the receptacle includes a bifurcated outwardly flared rim structure 138 comprising axially spaced-apart annular rings 139. The rings have a resilient sealing member 141 therebetween that forms a sliding seal with wall surface 132.

The receptacle wall 137 inclines downwardly and inwardly into a bottom wall 142. The bottom wall extends downwardly and inwardly into a rounded annular abutment area 145 which merges into a lower spout 146. The inside wall of the spout is provided with a plurality of inwardly extending tabs 148 that extend into corresponding tab indentations 149 on the outer surface of the lower section 158 of center pipe 160. The above described center pipe connector means serves to secure the pipe in an upright manner within the center of the receptacle. The pipe seals against spout inner wall 147. Alternatively, the center pipe and spout could be constructed as an integral one piece unit.

The inner surface of the center pipe lower section is provided with attachment means shown as threads 159 for connection with corresponding threads 53 on inlet pipe 54. As with the first embodiment of FIGS. 1–5, the inlet pipe connects with an underground liquid storage tank (not shown).

The center pipe upper section 162 extends into the receptacle center to a point proximate the axial midpoint of wall 137. Center pipe top edge 161 defines opening 163 with outer threads 164 forming a releasable connection with a protective/security cap (not shown) and a liquid supply line fitment (not shown)—both of which are known in the art.

Liquid flow from the receptacle into the tank inlet pipe occurs through one or more passageways 168 shown as extending through the center pipe wall. The passageways are at least coextensive with, and may be below, the annular abutment area 145 of the receptacle bottom wall 142. In this manner, accumulations of liquid in the receptacle will always flow by gravity to the passageways. Directly above the passageways is an annular outwardly facing sealing area 166 that includes inner sealing member 167.

Figure 7:
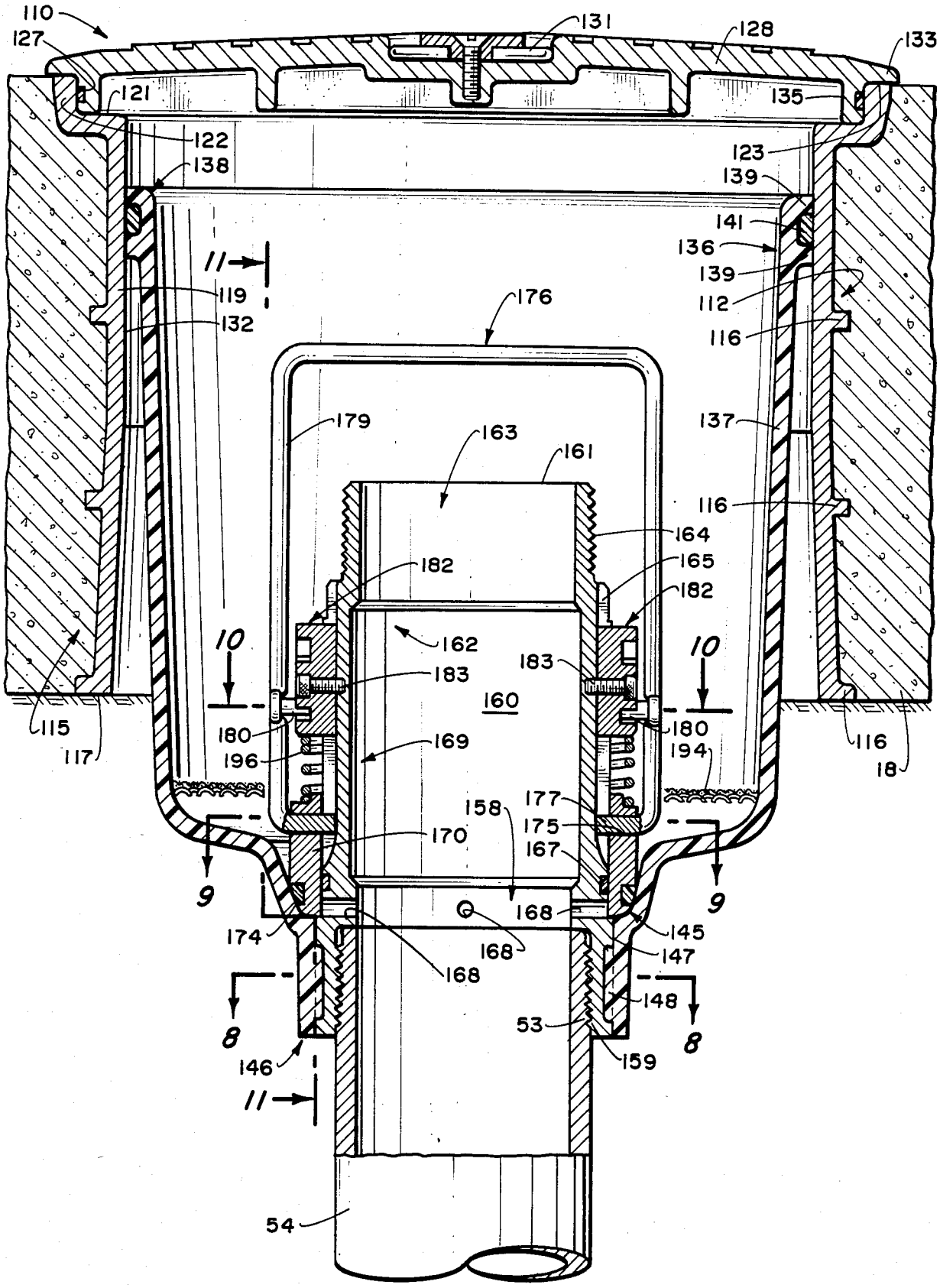
FIG. 7 is an enlarged cross-sectional view taken along lines 7—7 of FIG. 6 with the valve means in a closed position.
Figure 10:
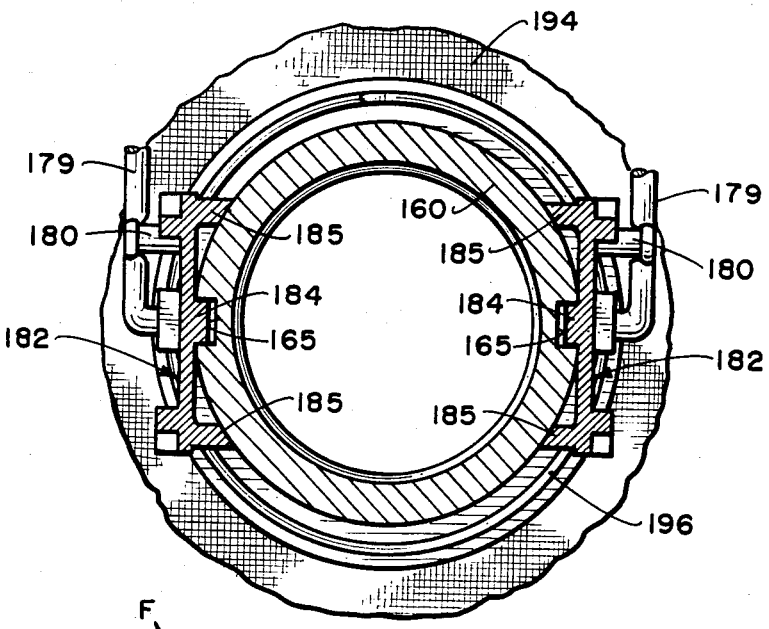
FIG. 10 is a cross-sectional view taken along lines 10—10 of FIG. 7.

Flow through the passageways is controlled by a valve means comprising a valve sleeve 170 in cooperating relation with cam track means and a handle 176. The valve sleeve is ring-like in structure and encircles the center pipe lower section 158. The sleeve inner wall 171 engages and seals against area 166 and member 167 of the center pipe. As best shown in FIG. 7, the sleeve has sufficient width to simultaneously overlie passageways 168 and at least sealing member 167 when in a closed position.

The outer lower corner 172 of the sleeve is preferably rounded to correspond with the curved surface of annular abutment area 145. As so arranged, the abutment area will function as a valve seat when the corner 172 is moved into engagement therewith.

To insure against leaks, sleeve corner 172 is notched and provided with an annular outer seal member 174. The seal member is adapted to resiliently contact the abutment area and form a liquid tight seal therewith.

Sleeve 170 is provided with handle pivot means for rotational attachment to handle 176. As shown, the pivot means comprises orifices 175,175 extending through each opposing side of the sleeve. The handle includes opposing inwardly directed free ends 177,177 each of which extend through a respective orifice and project into a respective longitudinal slot 165,165 on the exterior midsection of the center pipe.

The overall handle has an inverted U-shape with opposing legs 179,179 and an upper handle bar 178. The handle pivots about the aforesaid free ends within orifices 175,175 and moves axially pursuant their projection into longitudinal slots 165,165.

Each opposing handle leg includes an inwardly directed pin 180,180. Each pin is located above, and coextensive with, a respective free end 177. The pins extend into cam track means shown as opposing cam track parts 182,182.

The cam track parts are identical and are stationarily secured to opposing sides of the upper section 162 of the center pipe by bolts 183,183. The inside surfaces of each part include center adapter 184 which fits within slot 165 of the center pipe. The inside surface also includes side flanges 185,185 which extend inwardly from each side of the part against the center pipe. The contact ends of each flange are beveled to evenly engage corresponding surfaces of the center pipe circumference and maintain the part in transverse alignment for continuous engagement with pins 180.

Figure 11:
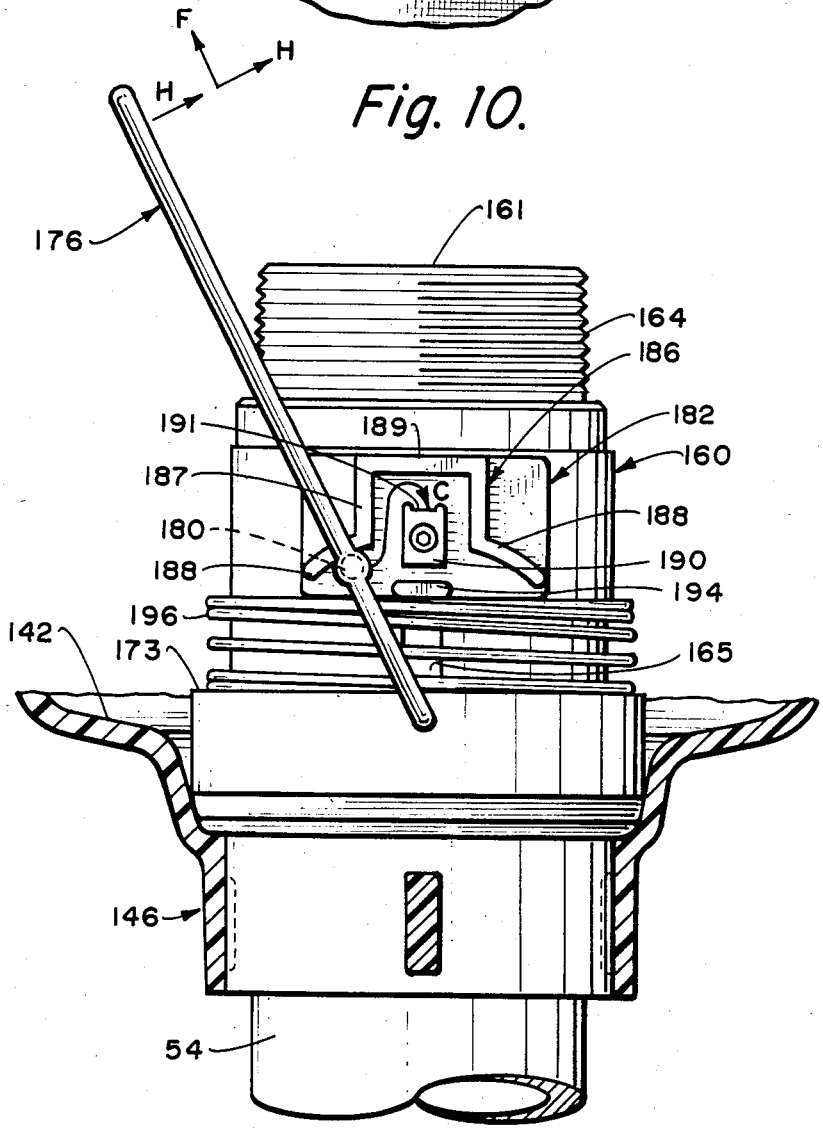
FIG. 11 is a cross-sectional view taken along lines 11—11 of FIG. 7.
Figure 13:
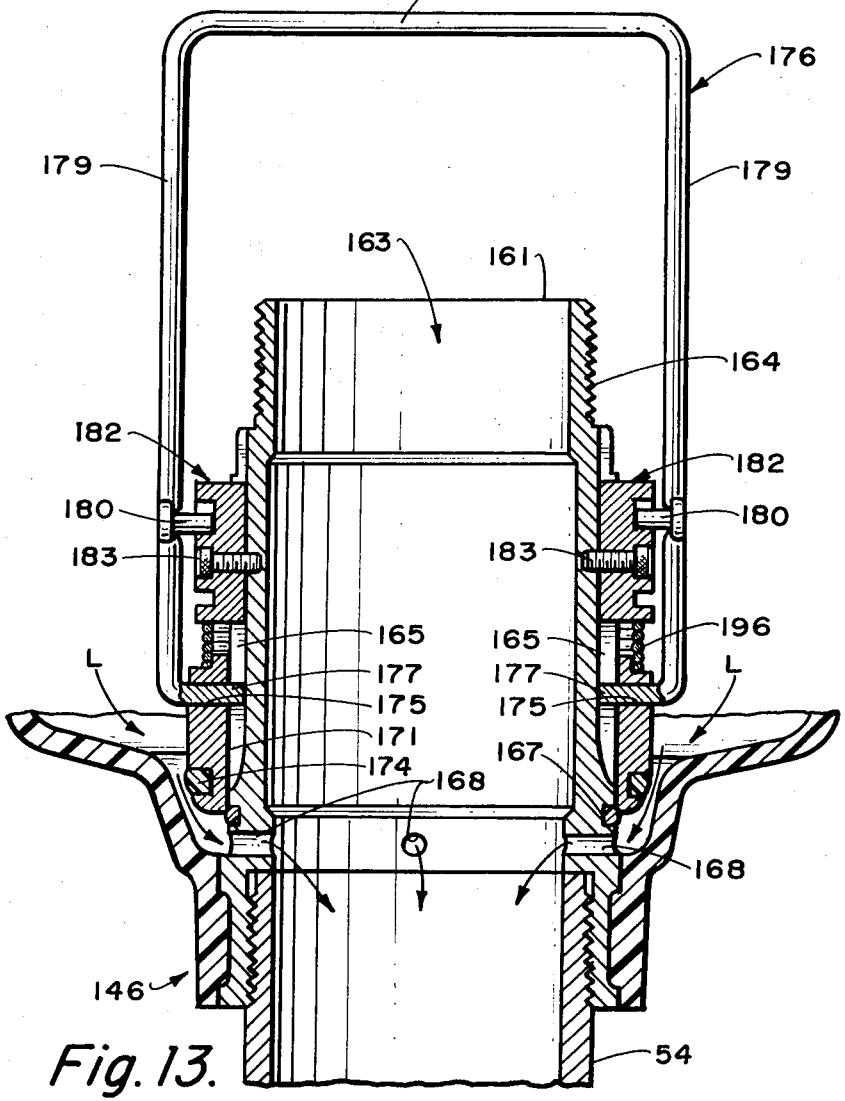
FIG. 13 is a cross-sectional view taken along lines 13—13 of FIG. 12.

The outer surfaces of each part include guide means forming a pathway, shown by arrow C in FIG. 11, for guiding movement of the handle pins. The pathway is generally S-shaped and defined by the area between outwardly extending guide projection 186 and center boss 190. The boss is located about the center of the cam track part and is integral therewith. It includes an indented top surface 191 upon which pin 180 may rest.

The guide projection is a continuous ridge-like structure somewhat in the shape of a U which is inverted over the boss and spaced therefrom a distance at least equal to the pin diameter. Each end of the U includes a downwardly inclined flared portion 188.

Extending outwardly from the bottom edge of each part is ear 194. The ear serves as an upper abutment for biasing means shown as coil spring 196 which encircles the outer surface of pipe mid-section 169. The stepped upper outer corner 173 of sleeve 170 serves as a lower abutment for the spring. When the sleeve is in its closed position, the cam track parts will be longitudinally adjusted during assembly, so that the spring will be slightly compressed between the aforesaid upper and lower abutments. As so disposed, the spring will always bias the sleeve into a closed position with seal members 167 and 174 functioning to prevent liquid flow through passageways 168.

To inhibit particulate matter from interferring with proper sealing and/or obstructing the passageways, a screen assembly 194 may be employed. The screen and support grid assembly preferably cover the bottom interior portion of receptacle 136 between the center pipe 160 and wall 137.

Figure 12:
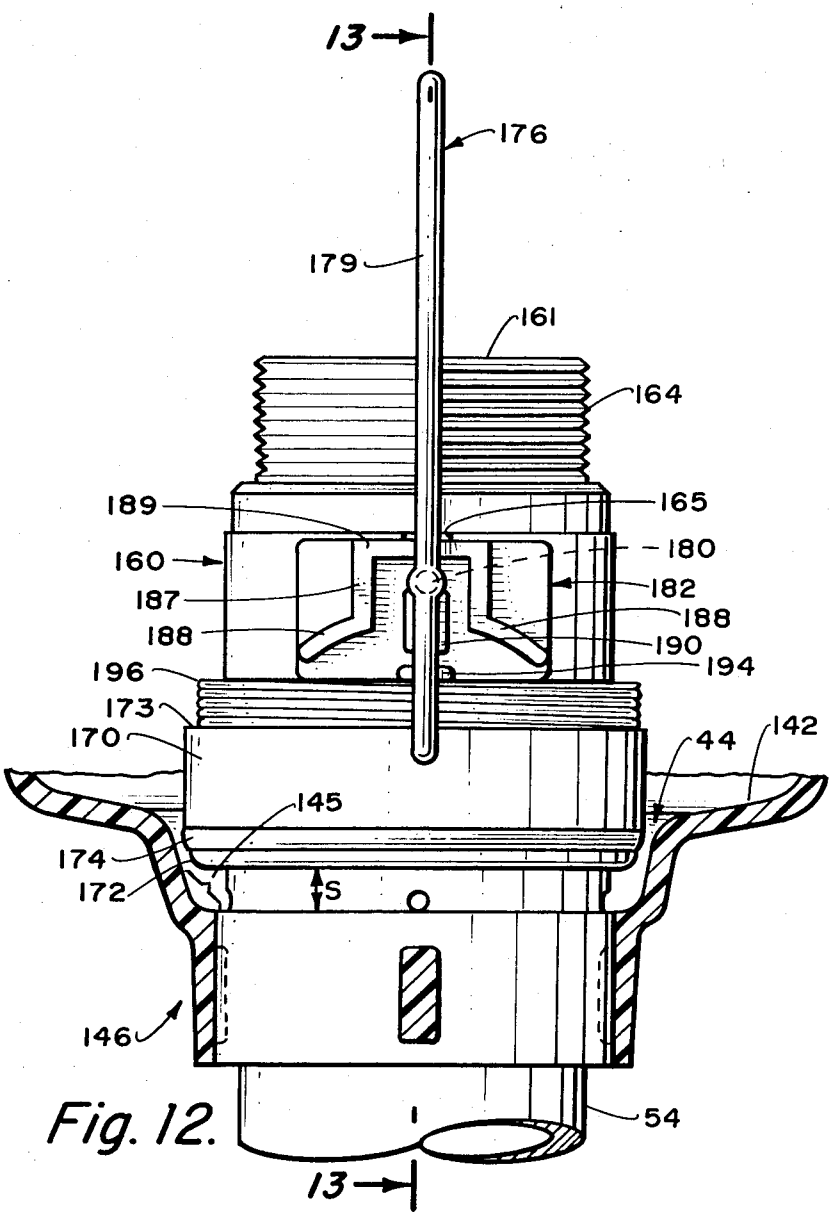
FIG. 12 is a cross-sectional view similar to FIG. 11 with the valve means in an open position.
Figure 14:
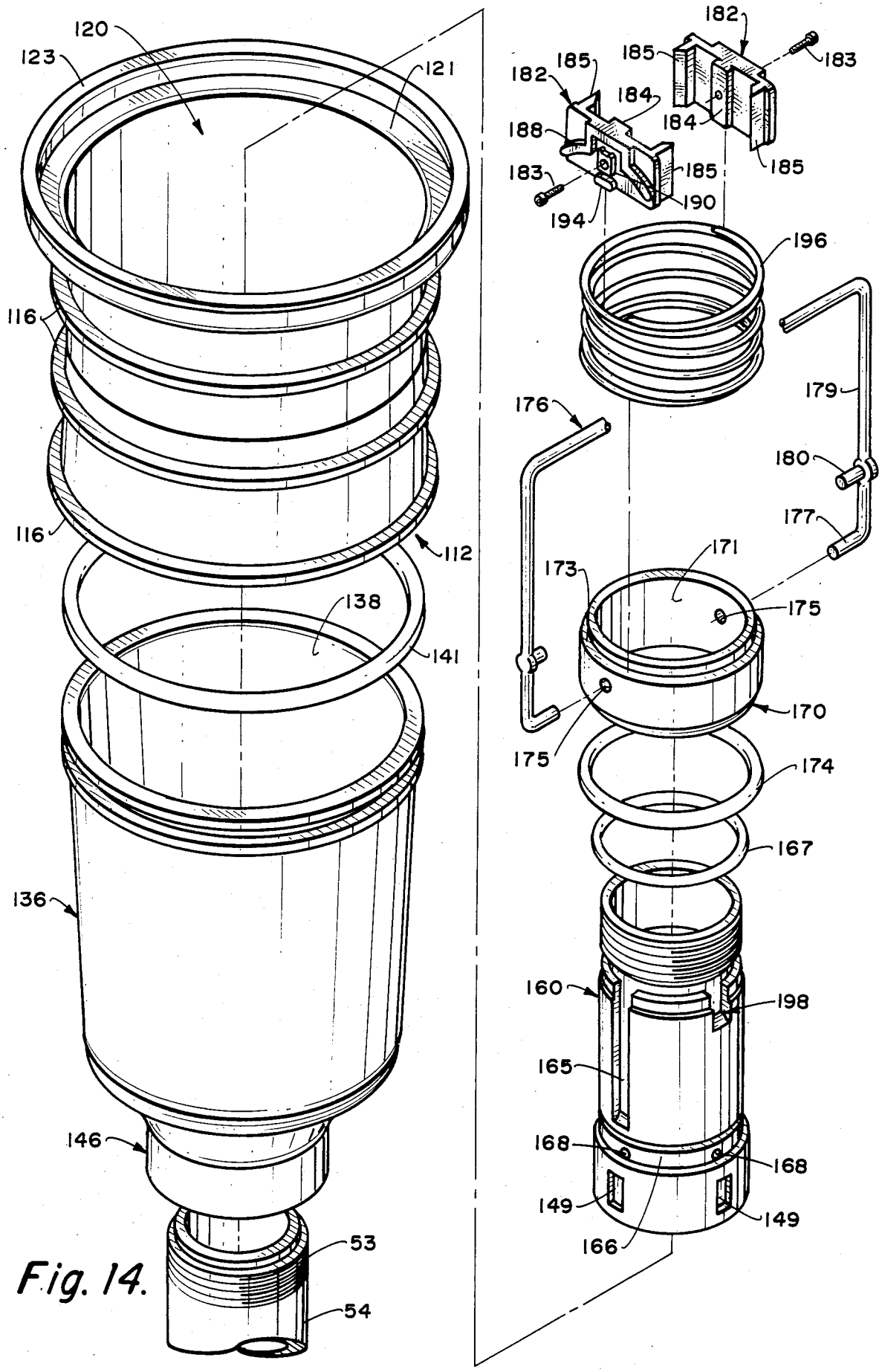
FIG. 14 is a perspective exploded view of the assembly shown in FIGS. 6–13 without a cover.

Except for actuating the valve means which is described below, the assembly, installation and operation of the above alternative embodiment is substantially similar to the FIGS. 1–4 embodiment. To drain spilled fluids accumulated within receptacle 136, an operator will grasp handle bar 178 and swing it in the direction of arrow H in FIG. 11. Pin 180 will move with the handle beneath the flared portion 188 of cam part 182. When the pin reaches the upwardly directed portion of pathway C beween the spaced-apart side wall of boss 190 and wall 187 of projection 186, an upward force F must be applied to the handle to lift the sleeve and/or overcome the compression strength of spring 196. Upon application of such force, pin 180 will move upwardly until it is adjacent the horizontal portion 189 of the guide projection. This action will simultaneously lift sleeve 170 in the direction of arrow S to an open position as shown in FIG. 12.

The handle (and pin) may then be swung to a position directly over the center pipe within the plane of its axis and the upward force released. This will allow the pin to be drawn down against surface 191 by the spring which will thereby maintain the sleeve in an open position. With the passages exposed, accumulated liquid will drain therethrough by gravity as shown by arrows L in FIG. 13.

The above sequence is reversed to close the valve means. Of course, once the handle is lifted and swung back to the vertical portion of pathway C, force from the spring will automatically draw the sleeve (and attached handle) down to a sealed position over the passageways.

Although two opposing cam track parts are shown and described, only one is necessary to carry-out the above operation. Also, it will be understood that the entire sequence can be performed by swinging the handle to either side of the center pipe since the handle and cam parts are constructed as bilateral mirror images. Further, use of spring 196 is optional and serves mainly to enhance operation of the sleeve.

Additionally, although the passageways are shown extending through the center pipe wall, it is within the scope of the present invention to form the passageways along the pipe circumference or within the receptacle spout or through an outlet pipe fitment or collar within, or adjacent to, the spout. In such cases, it is clear the valve sleeve would still regulate flow via the seals on opposing sides thereof.

A desirable feature of the FIGS. 6–14 embodiment, is that the handle provides an obstruction to accessing the center pipe and opening 163 when in a vertical orientation. The handle must be rotated to either side, which closes the valve means, before a supply line or protective cap can be attached. Further, the presence of a protective cap over opening 163 operates as a security means since it obstructs handle movement and thereby prevents unwanted valve opening. In this way, integrity of the underground tank contents is maintained.

Another desirable feature is that the entire interior assembly including the receptacle, center pipe and valve means can be removed from the stationary housing. Notches 198 (only one shown) are located on opposing exterior sides of pipe upper section 162 for engagement with a spanner wrench. This permits unscrewing the assembly from inlet pipe 54 and removal from the housing. This is highly advantageous since it allows for easy inspection of soil condition and facilitates maintenance and repair.

While the invention has been described with respect to preferred embodiments, modifications other than those described above may be made without departing from the scope and spirit of the invention. Accordingly, it is to be understood that the invention is not to be limited except by the scope of the appended claims.

We claim:

1. A liquid spill collector assembly for attachment to the inlet pipe of a storage vessel comprising:

a stationary outer housing having a top opening;

a receptacle mounted for at least axial movement within said housing having an open top portion with a side wall merging into a bottom wall and a lower drain outlet in communication with said inlet pipe, said housing having an inner wall surface with at least a part of said receptacle side wall in slidable engagement with said inner wall surface;

an upstanding center pipe secured within said drain outlet and positioned to block access to said outlet from said receptacle, said center pipe having passageways permitting access to said outlet; and, valve means for controlling access to said passageways.

2. The assembly of claim 1 wherein the receptacle top portion includes an outwardly facing rim for engagement with said inner wall surface.

3. The assembly of claim 2 wherein the housing inner wall surface includes abutment means for engagement with said outwardly facing rim to restrict the extent of axial receptacle movement.

4. The assembly of claim 3 wherein the receptacle outwardly facing rim engages said housing inner wall surface in the upper region thereof and the abutment means is located in the lower region of said wall surface.

5. The assembly of claim 2 wherein said rim includes a resilient member for sealing engagement with said inner wall surface.

6. The assembly of claim 1 wherein the housing top opening is defined by an upstanding rim and includes a downwardly offset outwardly extending flange.

7. The assembly of claim 6 including a cover overlying the housing top opening and said upstanding rim.

8. The assembly of claim 1 wherein the receptacle lower drain outlet is defined by a bottom wall merging into a downwardly extending spout.

9. The assembly of claim 8 wherein the spout includes attachment means for connecting said spout to the vessel inlet pipe.

10. The assembly of claim 9 wherein the spout includes securement means for connecting the center pipe to the receptacle drain outlet.

11. The assembly of claim 10 wherein said attachment means and said securement means comprise a coupling member secured to said spout for interconnecting the center pipe and vessel inlet pipe.

12. The assembly of claim 11 wherein said coupling member is secured to the inside wall of the spout and includes inner threads at each opposing end thereof for respective engagement with corresponding exterior threads at an upper end of said vessel inlet pipe and a lower section of said center pipe.

13. The assembly of claim 8 wherein the spout includes tabs extending from the spout into corresponding openings in said center pipe.

14. The assembly of claim 13 wherein the center pipe includes inlet pipe connector means for connecting said vessel inlet pipe to said center pipe.

15. The assembly of claim 1 wherein the valve means comprises a valve part which is movable relative to said passageways and releasably sealable therewith.

16. The assembly of claim 15 wherein said passageways comprise spaced-apart orifices extending through the wall of the center pipe.

17. The assembly of claim 16 wherein the passageways are about coextensive with the receptacle bottom wall.

18. The assembly of claim 15 wherein said valve part comprises a sleeve that encircles said center pipe and is axially movable thereon from a closed position in sealing disposition relative to said passageways to an open position out of sealing disposition relative to said passageways.

19. The assembly of claim 18 wherein the sleeve includes an inner seal member for sealing engagement with said center pipe above said passageways.

20. The assembly of claim 19 wherein the receptacle drain outlet includes a rim defining the opening thereto and the sleeve includes an outer seal member for engagement with said rim when the sleeve is in said closed position.

21. The assembly of claim 18 wherein said sleeve includes actuating means for moving the sleeve between said closed and open positions.

22. The assembly of claim 21 wherein said actuating means comprises a handle for manually moving said sleeve.

23. The assembly of claim 22 wherein said handle has an axial extent less than the vertical distance between the housing rim and sleeve when said sleeve is in the closed position and is greater than the vertical distance between the housing rim and sleeve when said sleeve is in the open position.

24. The assembly of claim 1 wherein said center pipe extends axially into said receptacle a distance less than the height of the receptacle side wall.

25. A liquid spill collector assembly comprising:

a housing embedded in foundation material;

a receptacle positioned within said housing having an upper portion in sliding engagement therewith and a lower portion forming a drain outlet;

a center pipe mounted within said drain outlet;

passageways adjacent said outlet permitting gravity flow of liquid from the receptacle to said drain outlet; and, valve means adjacent the drain outlet for controlling liquid flow through said passageways.

26. The collector assembly of claim 25 wherein said valve means includes a valve sleeve movably sealable over the passageways, a cam track means on the center pipe and a handle pivotally attached to said sleeve with a pin extending from said handle into sliding engagement with said cam track means.

27. The collector assembly of claim 26 wherein the cam track means comprises a cam track part having guide means forming a pathway for movement of said pin as the handle is moved about its pivot attachment with said sleeve.

28. The collector assembly of claim 27 wherein said sleeve is mounted upon said center pipe for axial movement and the pathway includes an upwardly directed portion which, when followed by the pin will cause said axial movement of the sleeve.

29. The collector assembly of claim 28 including a spring between the cam part and said valve sleeve.

30. The collector assembly of claim 29 wherein said guide means includes a center boss having an upper surface for supporting said pin when the sleeve is in an open position away from said passageways.

31. The collector assembly of claim 28 wherein the handle includes a handle bar portion that is located above the center pipe when said sleeve is in an open position away from said passageways and aside from the center pipe when said sleeve is in a sealed closed position over the passageways.

* * * * *